US006672404B2

(12) United States Patent
Kamo et al.

(10) Patent No.: US 6,672,404 B2
(45) Date of Patent: Jan. 6, 2004

(54) SCREW FASTENING MACHINE

(75) Inventors: Takeshi Kamo, Hitachinaka (JP); Yasuo Sasaki, Hitachinaka (JP); Michio Wakabayashi, Hitachinaka (JP)

(73) Assignee: Hitachi Koki Company, Ltd., Tokyo (JP)

( * ) Notice: Subject to any disclaimer, the term of this patent is extended or adjusted under 35 U.S.C. 154(b) by 0 days.

(21) Appl. No.: 10/188,806

(22) Filed: Jul. 5, 2002

(65) Prior Publication Data

US 2003/0010510 A1 Jan. 16, 2003

(30) Foreign Application Priority Data

Jul. 13, 2001 (JP) ..... 2001-212970

(51) Int. Cl.[7] ..... B25B 21/00

(52) U.S. Cl. ..... 173/11; 173/13; 173/93.5; 81/57.44; 81/434; 227/136

(58) Field of Search ..... 173/11, 93, 93.5, 173/13; 81/57.44, 57.37, 433, 469, 434; 227/130, 136

(56) References Cited

U.S. PATENT DOCUMENTS

| | | | | |
|---|---|---|---|---|
| 2,818,893 A | * | 1/1958 | Shaff | 81/430 |
| 5,730,035 A | * | 3/1998 | Ohmori et al. | 173/93.5 |
| 5,862,724 A | * | 1/1999 | Arata et al. | 81/434 |
| 6,026,713 A | * | 2/2000 | Ohmori et al. | 81/57.44 |
| 6,061,901 A | * | 5/2000 | Tanaka | 227/130 |
| 6,247,387 B1 | * | 6/2001 | Ketteringham | 81/469 |

FOREIGN PATENT DOCUMENTS

JP 11-262871 9/1999

* cited by examiner

*Primary Examiner*—Scott A. Smith
(74) *Attorney, Agent, or Firm*—Lowe Hauptman Gilman & Berner, LLP

(57) ABSTRACT

Two guide members cooperatively constitute a chuck portion for holding a screw head. Opening and closing of the chuck portion is regulated depending on a mutual position between a machine body and a member into which a screw is driven. Guide pin portions of respective guide members engage with a stopper portion of a push lever until a screw is driven to a predetermined depth. The chuck potion tightly holds the screw head until a screw fastening operation is substantially finished, thereby suppressing the lifting of a machine body.

5 Claims, 4 Drawing Sheets

SCREW FASTENING MACHINE

BACKGROUND OF THE INVENTION

The present invention relates to a screw fastening machine having a vertical guide which holds a screw when this screw is driven into a member to be fastened.

Unexamined Japanese patent publication No. 11-262871, assigned to the same applicant as that of this application, discloses a vertical guide positioned beneath a driver bit for holding a screw. A holding force of this vertical guide suppresses a lifting of a screw fastening machine caused by a reaction force acting from the screw driven into a material to be fastened.

FIG. 6 shows a vertical guide 41 disclosed in this prior art. The vertical guide 41 is attached to the lower end of a nose portion 36. The vertical guide 41 includes a pair of opposed guide members 22 which are swingable about their pivots. The guide members 22 are resiliently urged by springs 24 so as to close a chuck portion of the vertical guide 41.

Respective guide members 22 have screw holding faces 27 which are configured into pyramid faces directing downward. The screw holding force of guide members 22, especially the force for holding a screw head, substantially suppresses the lifting of this screw fastening machine.

The screw holding force becomes large with increasing inclination of each screw holding face 27.

As the screw head needs to be held until the screw fastening operation is almost finished, the guide members 22 are attached to the lowermost end of the machine body. In other words, the guide members 22 are positioned closest to the member into which the screw is driven.

According to the above-described screw fastening machine, however, when a pressing force applied to the machine body is insufficient, the machine body tends to lift upward due to a reaction force acting from the screw when the screw head is not yet held by the guide members 22. In this case, the reaction force is transmitted to the axes of a piston and a driver bit, i.e., transmitted to the axis of the screw fastening machine. Hence, a handle portion which is held by a user's hand will receive a significant rotation moment.

The rotation moment acting to the handle portion of a screw fastening machine possibly causes a driven screw to decenter from the axis of the machine body. The screw head may not be evenly held by respective screw holding faces 27 of guide members 22. Such unbalance of holing forces given from the screw holding faces 27 will let the screw come out of the guide members 22. The driver bit may exit out of the engaging grooves on the screw head.

In this manner, according to the conventional screw fastening machine, a duration the guide members 22 hold the screw head is insufficient for surely suppressing the machine body from lifting upward.

SUMMARY OF THE INVENTION

In view of the foregoing problems of the prior art, an object of the present invention is to provide a screw fastening machine which is capable of surely preventing the machine body from lifting due to a reaction force acting from a screw driven into a member to be fastened.

In order to accomplish this and other related objects, the present invention provides a screw fastening machine comprising a driver bit driven by an air motor and an air piston so as to reciprocate in an axial direction and rotate about its axis, a screw feeding portion for feeding screws one by one to a predetermined portion beneath the driver bit, a nose portion for guiding a screw when this screw is pushed out by the driver bit, and a vertical guide attached to a front end of the nose portion for holding the screw guided by the nose. The vertical guide of this invention has a chuck portion for holding a screw head, and opening and closing of the chuck portion is regulated depending on a mutual position between a machine body and a member into which the screw is driven.

According to a preferable embodiment of the present invention, it is preferable that a push lever has a stopper portion for restricting the opening motion of the chuck portion. The vertical guide has guide pin portions, and the chuck portion is in a closed condition when the stopper portion is brought into contact with the guide pin portions.

It is also preferable that the chuck portion is constituted by two opposed members which are resiliently urged to contact with each other. At least one of the opposed members has a screw holding face which is inclined with respect to an advancing direction of the screw so that a clearance from the screw holding face to the other opposed member decreases as a position approaches a distal end of the chuck portion.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF A PREFERRED EMBODIMENT

A preferred embodiment of the present invention will be explained with reference to FIGS. 1 to 5.

Figure 1:
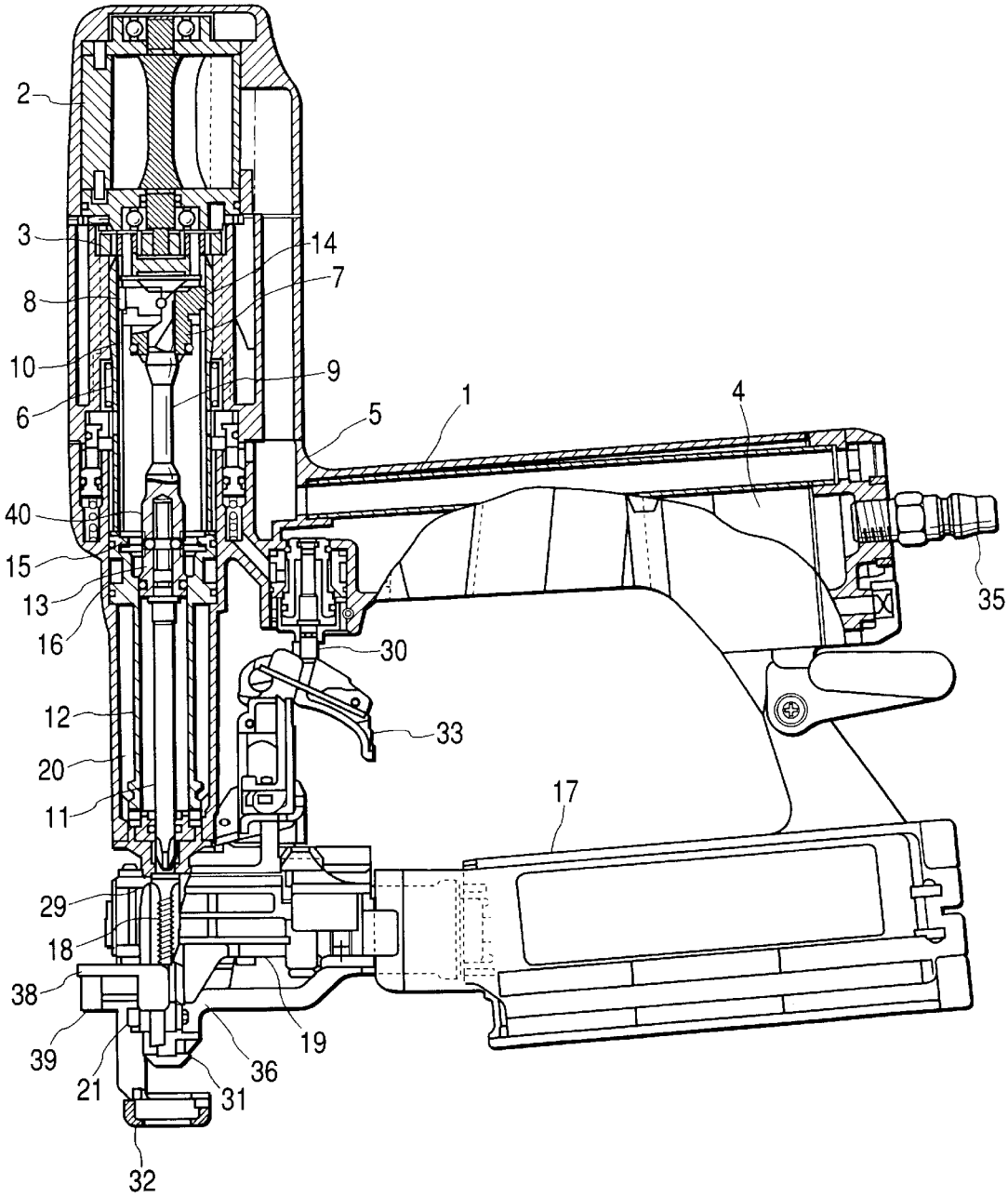
FIG. 1 is a partly cross-sectional vertical view showing a screw fastening machine in accordance with a preferred embodiment of the present invention.
Figure 2:
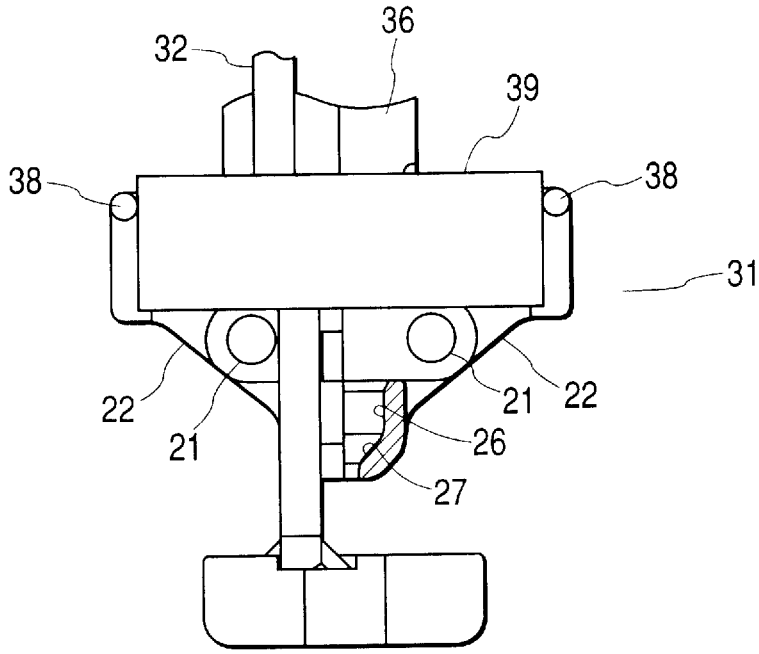
FIG. 2 is a partly cross-sectional and enlarged vertical view showing a vertical guide of the screw fastening machine shown in FIG. 1.

FIG. 1 shows a screw fastening machine held vertically with a driver bit extending in an up-and-down direction so as to drive a screw downward.

The screw fastening machine has a housing 5 configuring an outer frame of a machine body 1 in which an accumulator 4 and an operation valve 30 are accommodated. The accumulator 4 has a space for storing compression air and communicates with an air inlet port 35. A trigger lever 33 is positioned in the vicinity of the operation valve 30 for open and close controlling the operation valve 30. The trigger lever 33 is swingable about its pivot when manipulated by a user. The trigger lever 33 is mechanically linked with the operation valve 30 so that a swing motion of trigger lever 33 is converted into a reciprocative motion of a valve member of operation valve 30.

In FIG. 1, an air motor 2 is positioned at an upper end of the screw fastening machine. Rotation of air motor 2 is transmitted to a rotary member 6 via a planetary gear unit 3. The rotary member 6 has a cup-shaped configuration and is rotatable about its axis. A pair of recesses 10, formed on an inner wall of rotary member 6, extends in the axial direction of the rotary member 6. A rotary slide member 7 has a pair of projections 8 formed at the upper end thereof. The projections 8 of rotary slide member 7 are coupled in the recesses 10 of rotary member 6. Thus, the rotary slide member 7 can reciprocate along the inner wall of rotary member 6. A shaft member 9, having an upper end fixed to the rotary slide member 7, has a lower end in which a driver bit attaching portion 40 is formed. A piston portion 13 is provided around a lower end of the shaft member 9. The piston portion 13 slides in a cylinder 12. A plate portion 15, provided at an upper portion of cylinder 12, is brought into contact with an air shutoff surface 14 of rotary slide member 7 when the rotary slide member 7 is lowered a predetermined distance. An air port 16 is opened at the lower side of plate portion 15. The air port 16 is connected to an air inlet port (not shown) of the air motor 2 via an air passage (not shown). An air return chamber 20 is formed around the cylinder 12 in the lower part of the housing 5.

A nose portion 36 is positioned beneath the housing 5. A screw 18 and a driver bit 11 move in a hole extending in the nose portion 36. A screw feeding portion 19 is provided in the vicinity of the nose portion 36 for automatically feeding screws one by one from a magazine 17. The magazine 17 stores a plurality of screws 18 integrated by a connecting band (not shown).

A vertical guide 31, positioned beneath the machine body 1, has a pair of guide members 22 symmetrically arranged in the right and left direction. Each guide member 22 is attached to the nose portion 36 via a pin 21 at an altitudinal center portion. The upper portion of each guide member 22 is resiliently urged by a spring 24. The spring 24 is interposed between the upper portion of each guide member 22 and the nose portion 36. Lower portions of guide members 22 are brought into contact with each other so as to cooperatively constitute a chuck portion.

A guide pin portion 38, provided at an upper portion of each guide member 22, protrudes forward. Each guide member 22 has two vertical faces 26 and two inclined holding faces 27. The vertical faces 26 extend in the axial direction of the vertical guide 31. The holding faces 27 are inclined symmetrically with respect to the axis of the vertical guide 31. A clearance between two holding faces 27 decreases as a position approaches the lower end of the holding faces 27. For example, the holding faces 27 are square pyramid faces directing downward. When the two guide members 22 are brought into contact with each other by the resilient forces of springs 24, the holding faces 27 of respective guide members 22 form four inclined faces of a square pyramid. Four vertical faces 26 cooperatively define a space for just accommodating a screw head 29 (refer to FIG. 5).

A push lever 32, which is usually equipped in conventionally well known nail drivers or the like, is provided with a stopper portion 39. When the push lever 32 is pushed upward and positioned at its top dead center, the stopper portion 39 is positioned above the guide pin portion 38. The stopper portion 39 is located under the push lever 32. Both sides of the stopper portion 39 are brought into contact with the guide pin portions 38 when the push lever 32 is not positioned at its top dead center.

The above-described screw fastening machine of the present invention operates in the following manner.

The screw fastening machine of the present invention starts its operation when the operation valve 30 and the push lever 32 are manipulated at the same time. However, it is also possible for a user to start the operation of the screw fastening machine by pulling the trigger lever 33 (i.e., opening the operation valve 30) after the push lever 32 is depressed against a member to be fastened (not shown) or by depressing the push lever 32 against the member to be fastened while pulling the trigger lever 33.

When the air inlet port 35 is connected to a compressor (not shown), compression air flows into the accumulator 4 and the operation valve 30. A user manipulates the trigger lever 33 to activate the operation valve 30 under the condition where the push lever 32 is depressed against the member into which the screw 18 is driven. The compression air flows into the rotary member 6 from the accumulator 4 via the operation valve 30 and an air passage (not shown). A compression air pressure acts on an upper surface of piston portion 13. The piston portion 13 shifts downward. The compression air is supplied to the air motor 2 via the air port 16. The air motor 2 rotates. The rotation of air motor 2 is transmitted via the planetary gear unit 3 to the rotary member 6 and to the rotary slide member 7.

The piston portion 13 positioned at the lower end of shaft member 9 shifts downward and rotates together with the driver bit 11. In accordance with the composite motion of driver bit 11 shifting downward and rotating about its axis, the screw 18 positioned below the driver bit 11 is detached from the connecting band and is driven into a member to be fastened. During this fastening operation of screw 18, the piston portion 13 depresses the screw 18 while the machine body 1 receives a reaction force from the screw 18. Hence, the machine body 1 tends to lift upward.

Figure 3:
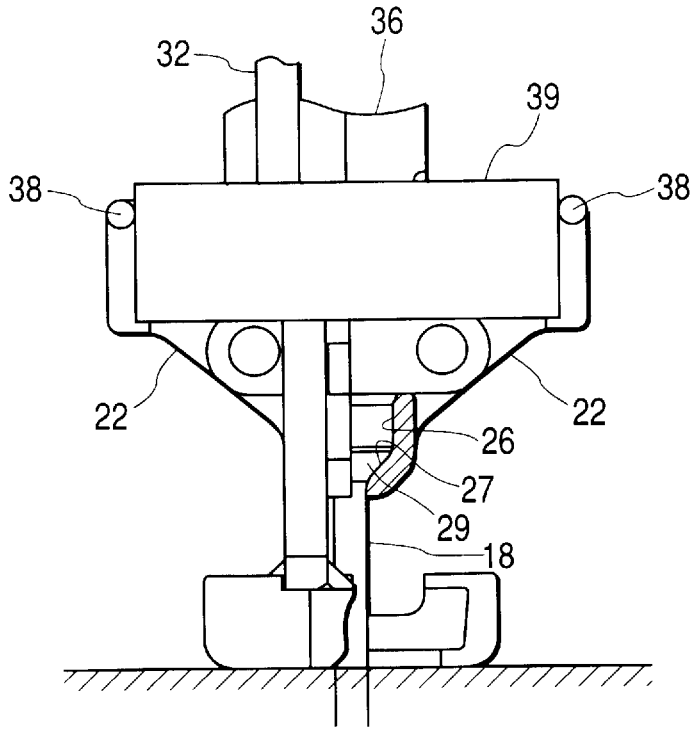
FIG. 3 is a partly cross-sectional and enlarged vertical view explaining an operated condition of the vertical guide of the screw fastening machine shown in FIG. 1.

As shown in FIG. 3, the screw 18 enters into an inside space of the chuck portion defined by the guide members 22. The screw head 29 contacts with the holding faces 27 and tries to forcibly open the chuck portion. However, each guide pin portion 38 contacts with the stopper portion 39 so as to prevent the guide members 22 from swinging. Thus, the chuck portion is kept in a closed condition so that the screw head 29 is tightly held by the holding faces 27 of guide members 22 (refer to FIGS. 3 and 5).

The guide members 22 are fixed to the housing 5. This prevents the machine body 1 from lifting upward. During the fastening operation of screw 18, in accordance with advancement of screw 18, the machine body 1 is pulled down toward the member into which the screw 18 is driven.

Figure 4:
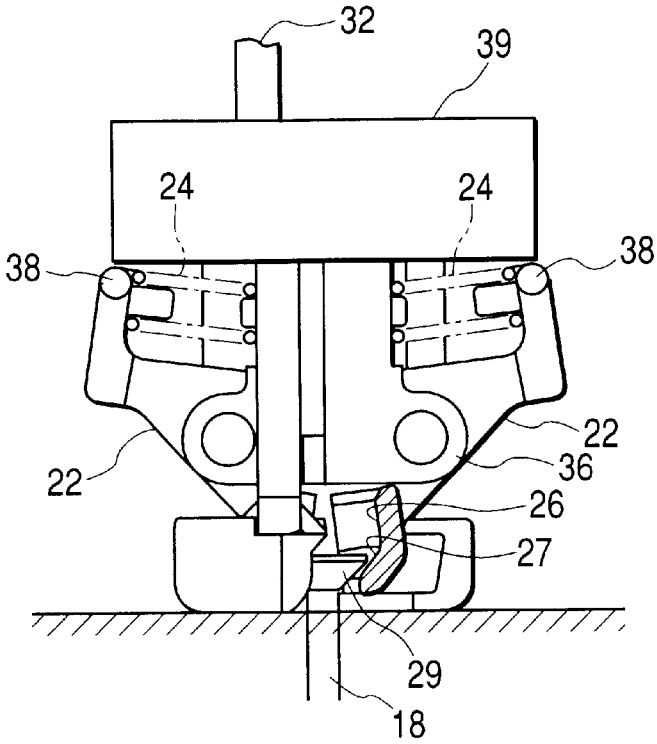
FIG. 4 is a partly cross-sectional and enlarged vertical view explaining another operated condition of the vertical guide of the screw fastening machine shown in FIG. 1.
Figure 5:
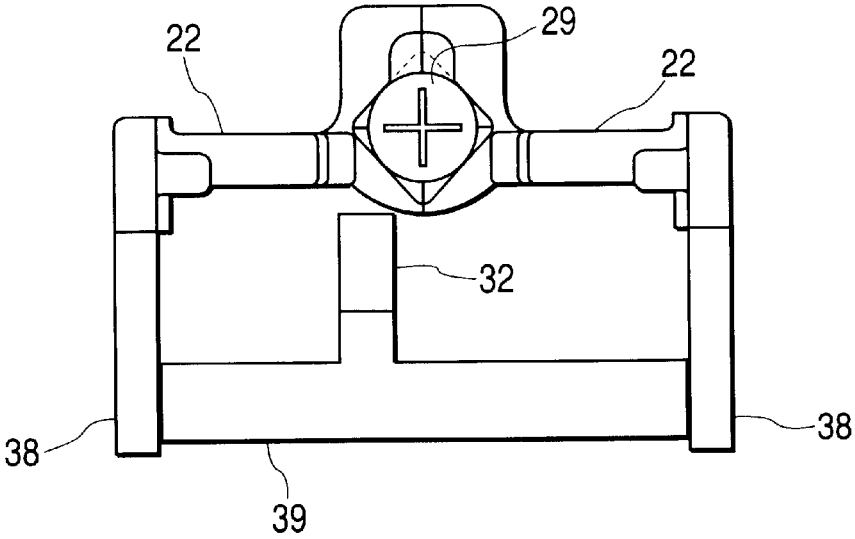
FIG. 5 is a plan view showing the vertical guide of the screw fastening machine shown in FIG. 3.
Figure 6:
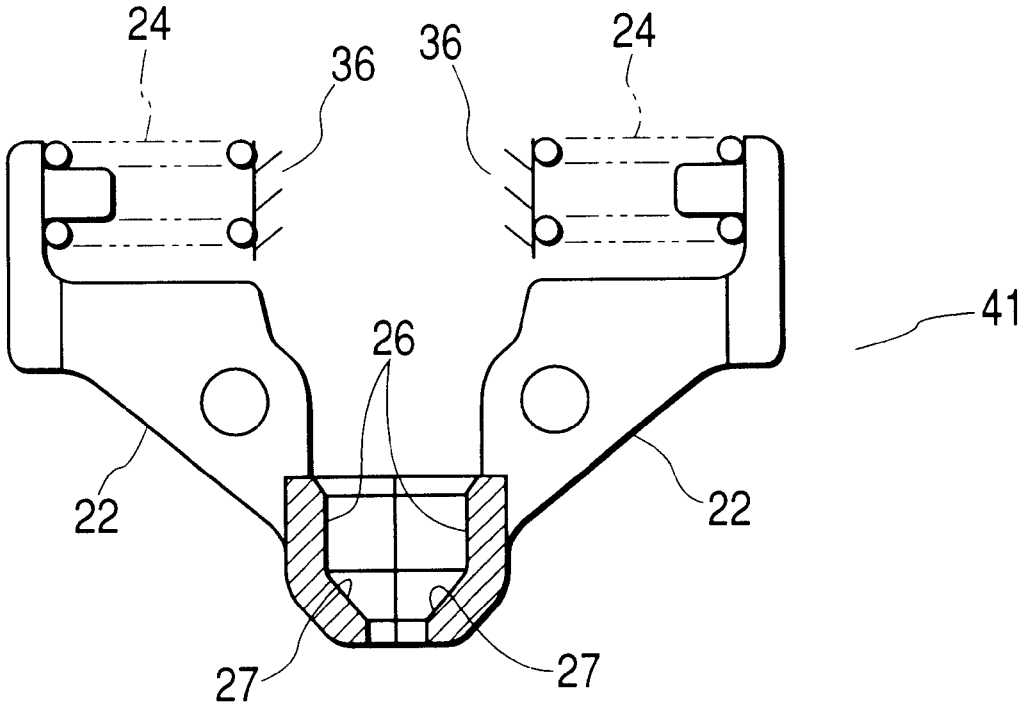
FIG. 6 PRIOR ART
FIG. 6 is a partly cross-sectional and enlarged vertical view showing a conventional vertical guide of a screw fastening machine.

FIG. 4 shows a condition of the vertical guide 31 where the push lever 32 has reached the top dead center at the moment the machine body 1 is completely pulled down. In this condition, the guide pin portions 38 are disengaged from the stopper portion 39 as shown in FIG. 4. The guide members 22 start swinging about their pivots so as to open the chuck portion as the screw head 29 pushes the guide members 22.

The machine body 1 receives a reaction force acting from the screw 18 until the screw 18 is fastened to a predetermined depth. In this case, the machine body 1 tends to lift upward due to the reaction force. However, the springs 24 resiliently urge the guide members 22. The resilient force of springs 24 makes it possible for the guide members 22 to tightly hold the screw head 29 even after the guide members 22 start swinging in the opening direction of the chuck portion. This prevents the machine body 1 from lifting upward until the fastening operation is finished.

After the screw 18 has reached the predetermined depth, the rotary slide member 7 hits the plate portion 15 and stops its downward shift movement. The air port 16 is closed and the air motor 2 stops rotating. When the user releases the trigger lever 33, the operation valve 30 returns to the home position. The flow of compression air into the rotary member 6 is stopped. The compression air stored in the air return chamber 20 returns the piston portion 13 to the initial position.

As explained above, according to the present invention, the opening and closing of the chuck portion holding the screw head is regulated or controlled depending on a mutual position between the machine body and the member into which the screw is driven. This makes it possible for the vertical guide to prevent the machine body from lifting upward during the screw fastening operation. In other words, the present invention enables a user to surely fasten a screw with a small pressing force applied on the screw fastening machine.

This invention may be embodied in several forms without departing from the spirit of essential characteristics thereof. The present embodiment as described is therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A screw fastening machine comprising:

a driver bit driven by an air motor and an air piston so as to reciprocate in an axial direction and rotate about its axis;

a screw feeding portion for feeding screws one by one to a predetermined portion beneath said driver bit;

a nose portion for guiding a screw when said screw is pushed out by said driver bit; and a vertical guide attached to a front end of said nose portion for holding said screw guided by said nose, wherein said vertical guide has a chuck portion for holding a screw head, and opening and closing of said chuck portion is regulated depending on a mutual position between a machine body and a member into which the screw is driven.

2. The screw fastening machine in accordance with claim 1, wherein a push lever has a stopper portion for restricting the opening motion of said chuck portion.

3. The screw fastening machine in accordance with claim 2, wherein said vertical guide has guide pin portions, and said chuck portion is in a closed condition when said stopper portion is brought into contact with said guide pin portions.

4. The screw fastening machine in accordance with claim 2, wherein said chuck portion is constituted by two opposed members which are resiliently urged to contact with each other.

5. The screw fastening machine in accordance with claim 4,wherein at least one of said opposed members has a screw holding face which is inclined with respect to an advancing direction of the screw so that a clearance from said screw holding face to the other opposed member decreases as a position approaches a distal end of said chuck portion.

* * * * *